United States Patent [19]

Lage

[11] 4,176,583

[45] Dec. 4, 1979

[54] DEVICE FOR CONDITIONING EXPENDED SHOTSHELLS

[76] Inventor: Frederick A. Lage, Rte. 2, Gladbrook, Iowa 50635

[21] Appl. No.: 877,125

[22] Filed: Feb. 13, 1978

[51] Int. Cl.[2] ..... F42B 33/00

[52] U.S. Cl. ..... 86/24; 86/33

[58] Field of Search ..... 86/23–39

[56] References Cited

U.S. PATENT DOCUMENTS

| | | | |
|---|---|---|---|
| 231,250 | 8/1880 | Worden | 86/37 |
| 249,986 | 11/1881 | Pontefract | 86/24 |
| 1,743,295 | 1/1930 | Tuffery | 86/36 |
| 2,738,699 | 3/1956 | Seavey et al. | 86/22 |
| 2,868,058 | 1/1959 | Dom | 86/24 X |

FOREIGN PATENT DOCUMENTS

| | | | |
|---|---|---|---|
| 777332 | 2/1935 | France | 86/37 |

*Primary Examiner*—Harold Tudor
*Attorney, Agent, or Firm*—Zarley, McKee, Thomte, Voorhees & Sease

[57] ABSTRACT

A device for conditioning expended shotshells comprising a support having one end thereof adapted to be connected to an apparatus for imparting vertical movement thereto. A swedge is secured to the support member and extends therefrom adapted for insertion into the expended shotshell to open the partially crimped end thereof and to remove the primer from the shell. The support includes a cup-shaped member having a ring-shaped spring mounted therein which is adapted to embrace the exterior surface of the crimped portion of the shotshell when the swedge is inserted into the shotshell. The spring smooths the crimped portion of the shotshell to facilitate subsequent loading of the shotshell.

5 Claims, 6 Drawing Figures

DEVICE FOR CONDITIONING EXPENDED SHOTSHELLS

BACKGROUND OF THE INVENTION

Shotshells or shotgun shells as they are commonly called generally comprise a brass base end and either a plastic or paper tubular body extending therefrom. Powder, wads and shot are positioned in the tubular body member and are maintained therein by the end of the tubular body being crimped upon itself.

The primer, upon being struck by the shotgun firing pin, ignites the powder within the tubular body member to force the wads and shot therefrom. The expended shotshells are frequently re-used or re-loaded. However, the re-loading of the shell is frequently difficult due to the crimps in the tubular body member adjacent the discharge end thereof. Subsequent crimping of the shell is difficult due to the previously formed crimps.

Therefore, it is a principal object of the invention to provide a device for conditioning spent shotshells to enable the subsequent re-loading thereof.

A still further object of the invention is to provide a device which smooths the crimped portion of an expended shotshell.

A still further object of the invention is to provide a device which not only smooths the crimped area of the shell but which also drives the spent primer therefrom.

A still further object of the invention is to provide a device which opens and smooths the crimped portion of the shell and drives the spent primer therefrom in a single operation which is quick and convenient.

A still further object of the invention is to provide a device of the type described which is economical of manufacture, durable in use and refined in appearance.

These and other objects will be apparent to one skilled in the art.

SUMMARY OF THE INVENTION

Figure 1:
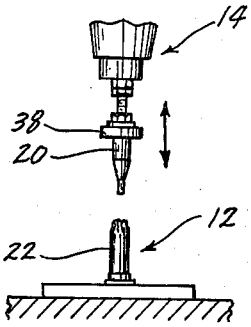
FIG. 1 is a side view illustrating the device just prior to its being employed to condition the shotshell.

The device comprises a cup-shaped support having a threaded member extending therefrom which is adapted to be inserted into some sort of device having vertical or longitudinal movement capability. A swedge is secured to the support and is adapted to be inserted into the shotshell to open partially the crimped portion thereof and to drive the spent primer therefrom. A ring-shaped spring is positioned within the cup-shaped support and is adapted to embrace and engage the exterior crimped portion of the shell as the swedge member is extended thereinto so as to smooth the crimped portion to facilitate subsequent re-loading operations.

DESCRIPTION OF THE PREFERRED EMBODIMENT

The device of this invention is referred to generally by the reference numeral 10 while the reference numeral 12 refers to a conventional shotshell or shotgun shell. The numeral 14 refers to a conventional apparatus having the capability to be raised or lowered as indicated by the arrows in FIG. 1. A suitable apparatus 14 would be a drill press or the like.

Device 10 includes a conventional swedge 16 having an elongated threaded member 18 extending from one end thereof as seen in the drawings. Swedge 16 includes a body portion 20 which has an outside diameter substantially equal to the inside diameter of the tubular body portion 22 of the shell 12. Swedge 16 also includes an end portion 24 which is adapted to drive or remove the spent primer 26 from the base end 27 of the shell as the swedge is inserted into the shell.

Figure 2:
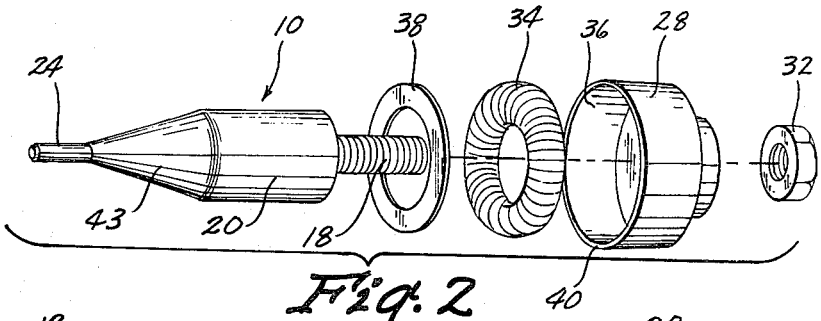
FIG. 2 is an exploded perspective view of the device.
Figure 3:
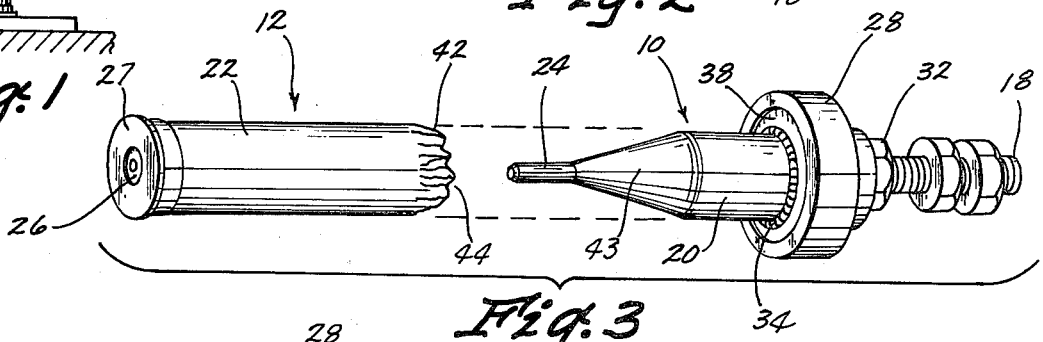
FIG. 3 is a perspective view of the device and a spent shotshell.
Figure 4:
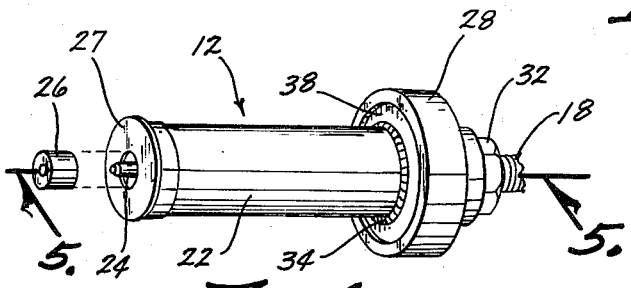
FIG. 4 is a view similar to FIG. 4 except that the device has been inserted into the shell and the primer driven therefrom.
Figure 5:
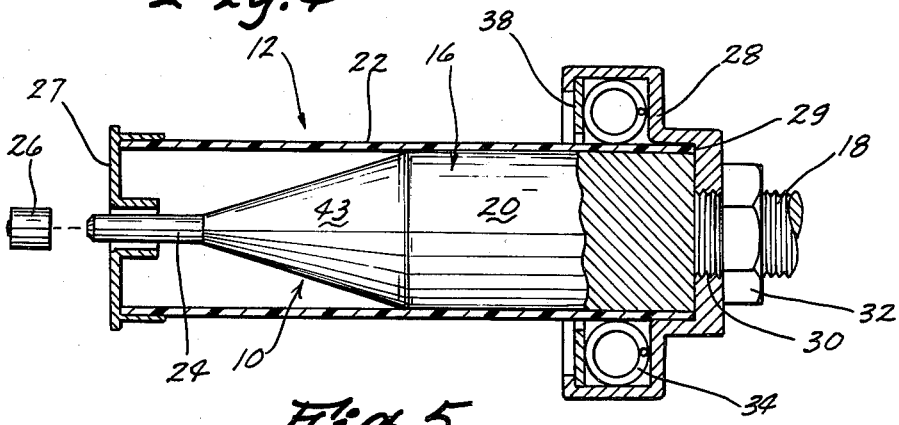
FIG. 5 is an enlarged sectional view seen on lines 5—5 of FIG. 4.

The cup-shaped support 28 is mounted on the threaded member 18 by means of the threaded member 18 extending through the opening 30 in support 28. Nut 32 is threadably mounted on the threaded member 18 for maintaining the cup-shaped support in position as illustrated in FIG. 5. The numeral 34 refers to a ring-shaped spring which is inserted into the open end 36 of the support 28. Washer 38 is positioned adjacent the face of the spring 34 as illustrated in FIG. 5. Spring 34 and washer 38 are maintained in position by crimping the end portion 40 of support 28 downwardly from the position of FIG. 2 to the position of FIG. 3. The inside diameter of spring 34 is slightly less than the outside diameter of tubular body portion 22 so that the spring 34 will firmly embrace the portion 22 as will be described hereinafter.

Figure 6:
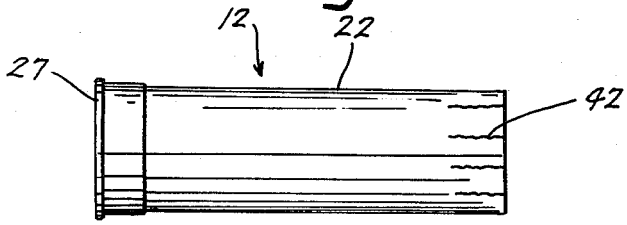
FIG. 6 is a plan view of the shotshell after it has been conditioned by the device of this invention.

The device is used to recondition or condition the spent shotshell 12 as follows. The device 10 is mounted in the apparatus 14 by any suitable means such as by inserting the threaded member 18 into a chuck or the like. Shell 12 is then positioned on a suitable support below the apparatus as illustrated in FIG. 1. Apparatus 14 is then lowered so that the end portion 24 of swedge 16 is inserted downwardly into the crimped portion of the shell referred to by the reference numeral 42. As swedge 16 is inserted into the shell 12, the tapered portion 43 opens the crimped portion of the shell so that the discharge end 44 of the shell is opened. Continued insertion of the swedge member into the shell causes the crimped poriton 42 to be positioned between the spring 34 and the swedge 16 as illustrated in FIG. 5. The portion 29 of support 28 limits the insertion of the swedge into the shell as also seen in FIG. 5. The insertion of the crimped portion between the swedge and the spring 34 causes the spring 34 to firmly embrace and engage the exterior crimped portion of the shell and to smooth the crimped portion thereof as illustrated by the conditioned shell in FIG. 6. The spring 34 does not completely remove the crimps but does smooth the same to such a degree that the shell may be easily re-loaded. If the crimped portion is not smoothed, it is difficult to insert the powder, wads and shot as well as forming a new crimp to maintain the same therein.

Thus it can be seen that a novel device has been provided which does recondition expended shotshells to facilitate subsequent loading.

I claim:

1. A shotshell reconditioner, comprising, a first support means, a swedge means secured to said support means and extending therefrom for insertion into the partially crimped portion at the discharge end of the shotshell, and a ring-shaped spring means mounted to said support means adapted to embrace and engage the exterior portion of said shotshell as said swedge means is inserted into the shotshell whereby said spring means will substantially smooth the said crimped portion as to facilitate a subsequent loading operation, said ring-shaped spring means having an inside diameter which is less than the outside diameter of the shotshell so that said spring means will firmly slidably embrace the crimped portion of the shotshell as said swedge means is inserted into the shotshell.

2. The device of claim 1 wherein said ring-shaped spring is generally circular in cross section, thereby providing a tapered recess between said swedge means and spring which is resiliently expandable by said shotshell as said swedge means is inserted into the shotshell.

3. The device of claim 1 wherein said first support means comprises a cup-shaped support which embraces said ring-shaped spring means, said swedge means being secured to said cup-shaped support and extending therefrom through said ring-shaped spring means, the inside diameter of said spring means being spaced from said swedge means.

4. The device of claim 3 wherein said swedge means has a primer remover at one end thereof, the length of said swedge means being such that said primer remover will extend through the primer hole in the shotshell when said spring means is embracing said crimped portion.

5. The device of claim 4 wherein said cup-shaped support defines a stop means to limit the movement of said swedge means into the shotshell.

* * * * *